US007226281B2

(12) United States Patent
Kato et al.

(10) Patent No.: US 7,226,281 B2
(45) Date of Patent: Jun. 5, 2007

(54) VANE PUMP HAVING VANES SLANTED RELATIVE TO ROTATIONAL AXIS

(75) Inventors: Yasuo Kato, Niwa-gun (JP); Yoshichika Yamada, Kuwana (JP)

(73) Assignee: DENSO Corporation (JP)

( * ) Notice: Subject to any disclaimer, the term of this patent is extended or adjusted under 35 U.S.C. 154(b) by 0 days.

(21) Appl. No.: 11/266,377

(22) Filed: Nov. 4, 2005

(65) Prior Publication Data

US 2006/0099102 A1 May 11, 2006

(30) Foreign Application Priority Data

Nov. 5, 2004 (JP) ..... 2004-321986

(51) Int. Cl.
*F01C 1/00* (2006.01)
*F03C 2/00* (2006.01)

(52) U.S. Cl. ..... 418/236; 418/259; 418/268; 73/40

(58) Field of Classification Search ..... 418/236, 418/259, 266–268; 73/40, 46, 47, 49.7, 118.1
See application file for complete search history.

(56) References Cited

U.S. PATENT DOCUMENTS 2,195,812 A * 4/1940 Czarnecki ..... 418/236
6,537,047 B2 * 3/2003 Walker ..... 418/236
2004/0149016 A1 * 8/2004 Kano et al. ..... 73/40

FOREIGN PATENT DOCUMENTS

JP 57083689 A * 5/1982 ..... 418/236
JP 63263283 A * 10/1988 ..... 418/236
JP 6-147156 5/1994

* cited by examiner

*Primary Examiner*—Theresa Trieu
(74) *Attorney, Agent, or Firm*—Nixon & Vanderhye PC

(57) ABSTRACT

A vane pump is composed of a casing having a cylindrical inner bore and a rotor disposed in the inner bore with an eccentric relation to the inner bore. A circular pump chamber formed between the rotor and the inner bore is divided by vanes disposed in the rotor into plural pump chambers each changing its capacity according to rotation of the rotor. The vane is slidably disposed in a groove formed in the rotor in a slanted relation with respect to a rotational axis of the rotor. When the rotor rotates, the vane is pushed backward of the rotational direction by fluid in the pump chamber. The pushing force includes a component for pushing the vane upward toward an upper plate closing an upper opening of the inner bore. The vane is pushed against the upper plate to thereby prevent hitting noises between the vane and the upper plate.

2 Claims, 4 Drawing Sheets

VANE PUMP HAVING VANES SLANTED RELATIVE TO ROTATIONAL AXIS

CROSS-REFERENCE TO RELATED APPLICATION

This application is based upon and claims benefit of priority of Japanese Patent Application No. 2004-321986 filed on Nov. 5, 2004, the content of which is incorporated herein by reference.

BACKGROUND OF THE INVENTION

1. Field of the Invention

The present invention relates to a vane pump for compressing or decompressing fluid.

2. Description of Related Art

A vane pump having a rotor rotating in an eccentric relation with respect to an inner bore of a casing is known hitherto. The vane pump has vanes disposed in grooves formed in the rotor to extend in the axial direction. The vanes move in the radial direction according to rotation of the rotor so that radial ends of the vanes slidably contact the inner bore of the casing. An axial length of the vane is made a little smaller than an axial length of the groove to allow its smooth movement in the groove. In other words, small gaps are formed between the vane and casing. Accordingly, the vane moves also in the axial direction according to rotation of the rotor and tends to hit the casing, generating hitting noises.

JP-A-6-147156 proposes a vane pump that has resilient rings for pushing the vanes in the radial direction against the inner bore of the casing. By pushing the vanes against the inner bore, movement of the vanes in the axial direction is also suppressed. In the proposed vane pump, however, it is necessary to provide the resilient rings that make the vane pump complex and expensive.

SUMMARY OF THE INVENTION

The present invention has been made in view of the above-mentioned problem, and an object of the present invention is to provide an improved vane pump, in which the hitting noises are prevented without using additional members such as resilient rings.

The vane pump includes a casing having a cylindrical inner bore and a rotor disposed in the inner bore with an eccentric relation to the inner bore. A circular pump chamber is formed between the inner bore and the rotor. Vanes are disposed in the rotor so that the circular pump chamber is divided into plural pump chambers each changing its capacity according to rotation of the rotor. Each vane is slidably disposed in a groove formed in the rotor so that its radial outer end slidably contacts the inner bore of the casing. Axial ends of the inner bore are closed with an upper plate and a lower plate. The groove is formed to slant with respect to a rotational axis of the rotor. The groove is slanted so that its lower end is located frontward of a rotational direction of the rotor and its upper end is located backward of the rotational direction.

As the rotor rotates around the rotational axis, the vane disposed in the slanted groove is pushed backward of the rotational direction by fluid in the pump chamber. The pushing force has a component vertical to the surface of the vane and a component parallel to the surface of the vane. The vane is pushed against a wall of the groove by the vertical component, while the vane is pushed upward against the upper plate closing the upper axial end of the inner bore.

Since the vane is pushed upward against the upper plate according to rotation of the rotor, the vane does not move in the axial direction. That is, the vane does not hit the upper plate while the rotor is being rotated, and therefore the hitting noises are prevented without using any other additional component to restrict movement of the vane. A cross-section of the vane taken along a plane parallel to the rotational axis is made in a parallelogram shape, so that the upper end surface of the vane contacts the upper plate with a surface-to-surface relation. This suppresses abrasion wear of the vane and the upper plate.

The slanting direction of the groove may be reversed, so that the lower end of the groove is positioned backward of the rotational direction. In this case, the lower surface of the vane is pushed against the lower plate according to rotation of the rotor, thereby suppressing the hitting noises between the vane and the lower plate. The vane pump of the present invention may be used in a system for checking leakage in a fuel evaporation control system mounted on an automotive vehicle. Since a pump for sucking air in a fuel tank is driven when an engine is not operated, it is important to use a pump generating low noises. Since the vane pump of the present invention generates low noises, it can be advantageously applied to the system for checking leakage.

Other objects and features of the present invention will become more readily apparent from a better understanding of the preferred embodiment described below with reference to the following drawings.

DETAILED DESCRIPTION OF THE PREFERRED EMBODIMENT

Figure 1:
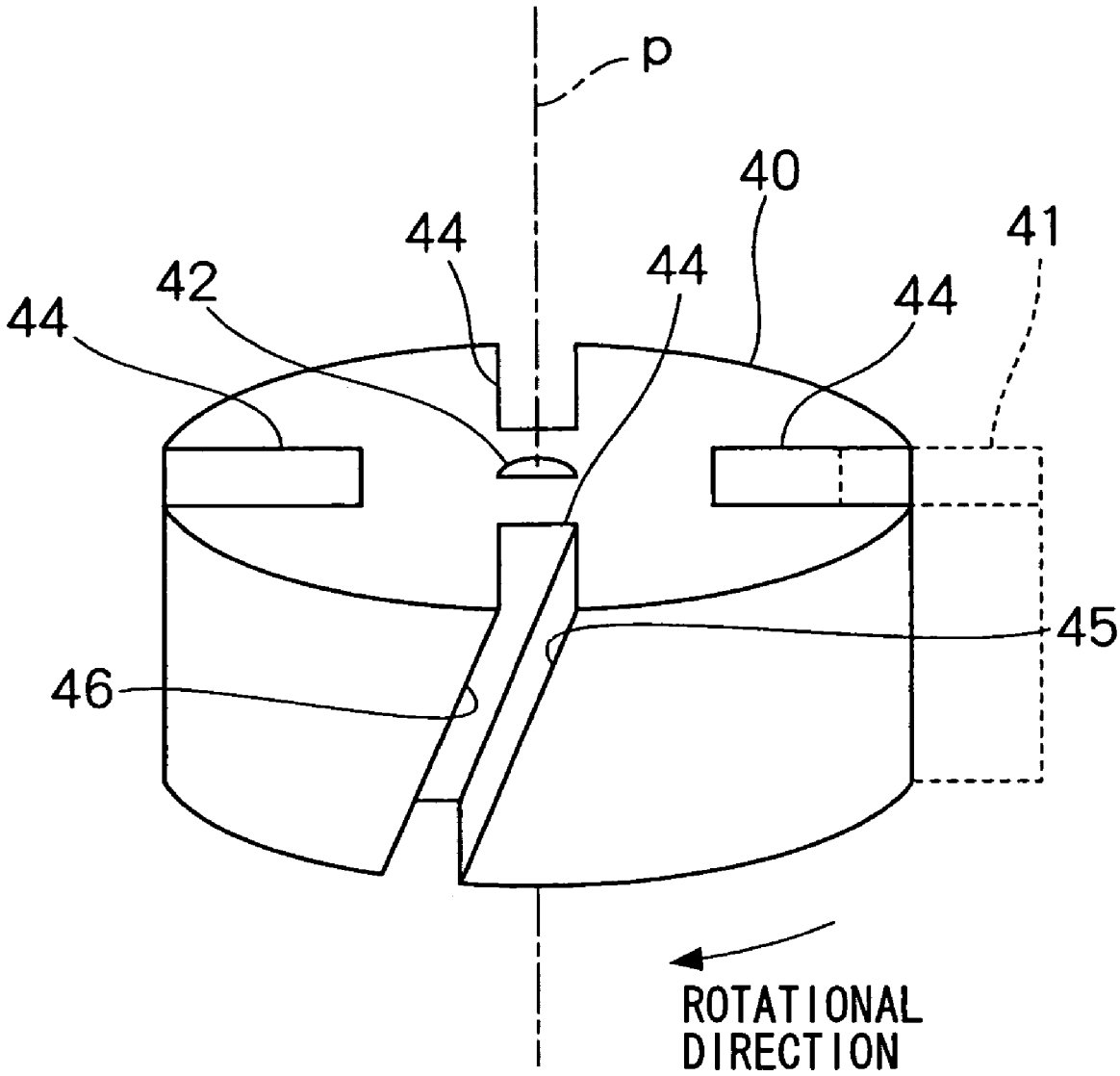
FIG. 1 is a perspective view showing a rotor of a vane pump according to the present invention.

A preferred embodiment of the present invention will be described with reference to FIGS. 1-4. First, referring to FIGS. 2 and 3, a structure of a vane pump 10 will be described. The vane pump compresses or decompresses fluid such as gas or liquid. The vane pump 10 includes: a casing composed of a ring 20, a lower plate 31 and an upper plate 32; a rotor 40; vanes 41 and a driving shaft 13. The rotor 40 disposed in an inner bore 21 of the ring 20 is coupled to the driving shaft 13 and rotated by a motor 11. The motor 11 may be an electric motor such as a direct current motor or an alternating current motor. The motor 11 is contained in a cover 12.

Figure 3:
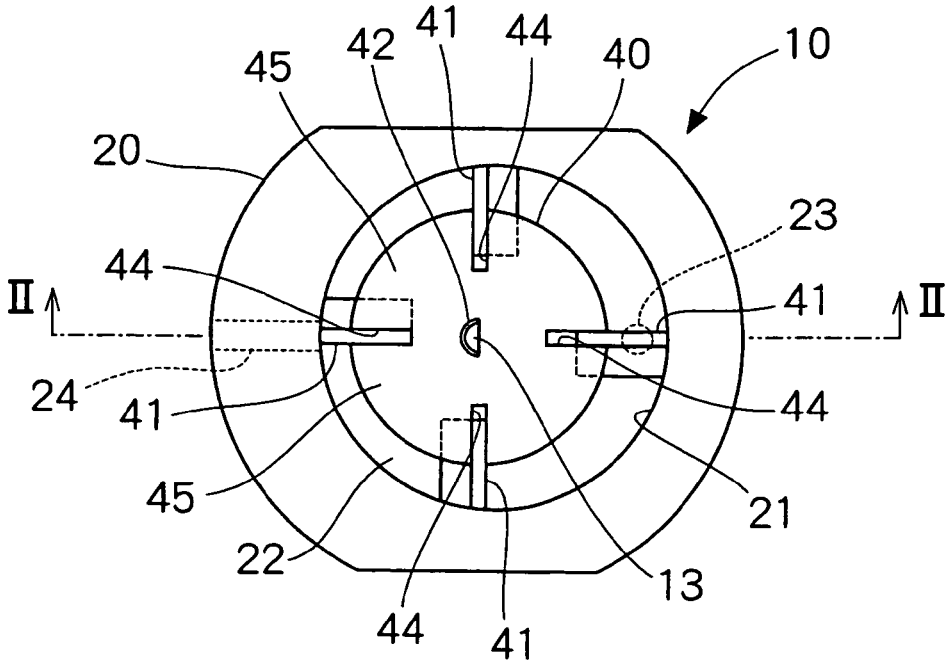
FIG. 3 is a plan view showing the vane pump, viewed in direction III shown in FIG. 2 with an upper plate removed.

The ring 20 is cylinder-shaped and has a cylindrical inner bore 21. The inner bore 21 may be formed in an oval form. Both axial ends of the ring 20 are closed with the lower plate 31 and the upper plate 32. A rotational axis of the rotor 40 disposed in the inner bore 21 is positioned in an eccentric relation with respect to a center of the inner bore 21. A center hole 42 to which the driving shaft 13 is coupled is formed in line with the rotational axis. A space between the rotor 40 and the inner bore 21 of the ring 20 closed with the plates 31, 32 constitutes a circular pump chamber 22. A capacity of the pump chamber 22 is not uniform in its circular direction, but continuously changes as shown in FIG. 3 because the rotor 40 is positioned eccentrically relative to the inner bore 21 of the ring 20.

Figure 2:
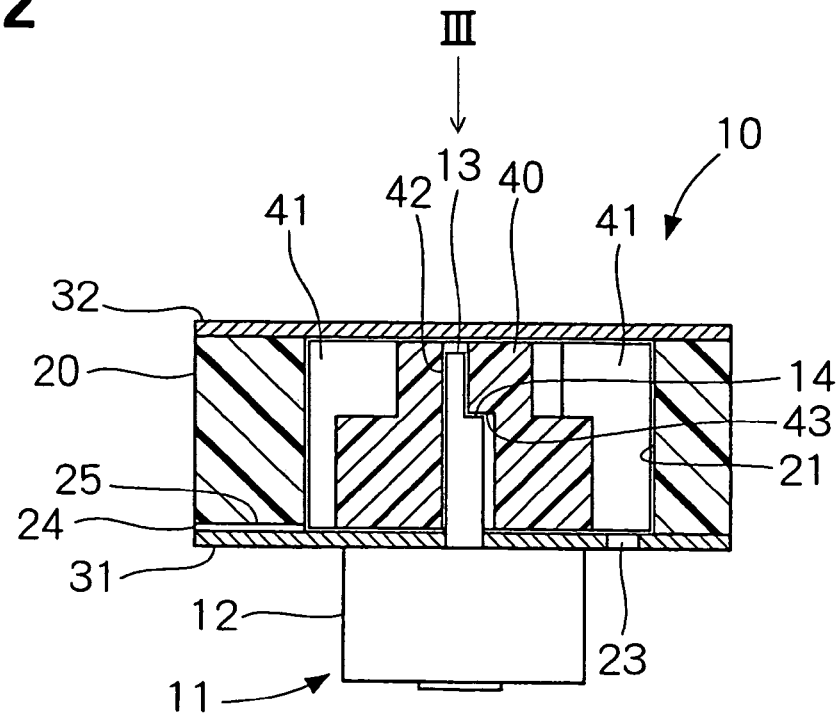
FIG. 2 is a cross-sectional view showing the vane pump, taken along line II-II shown in FIG. 3.

As shown in FIG. 2, an inlet port 23 communicating with the pump chamber 22 is formed in the lower plate 31, and an outlet passage 24 communicating with the pump chamber 22 is formed between a groove 25 of the lower plate 31 and the ring 20. According to rotation of the rotor 40, fluid is sucked into the pump chamber 22 from the inlet port 23, pressurized in the pump chamber 22 and pumped out through the outlet passage 24.

The rotor 40 has a center hole 42 formed at the rotational axis of the rotor 40. The driving shaft 13 is inserted into the center hole 42. As shown in FIG. 2, the center hole 42 has a circular cross-section from the lower end up to its middle portion and has a half circular cross-section from the middle portion to the upper end, thereby forming a step 43 at the middle portion. The driving shaft 13 has a cross-section corresponding to the cross-section of the center hole 42. That is, a lower portion of the driving shaft 13 has a circular cross-section and its upper portion has a half circular cross-section, forming a step at its middle portion. The driving shaft 13 is coupled to the center hole 42 of the rotor 40 so that the step 14 of the driving shaft 13 abuts the step 43 of the center hole 42. The center hole 42 and the driving shaft 13 may be made round without making the steps, and both may be coupled by press-fitting.

The rotor 40 has grooves 44, formed in its outer periphery, extending substantially in the axial direction. Four grooves 44 are formed at an equal interval in this particular embodiment. However, the number of the grooves 44 is not limited to four. Each vane 41 is disposed in each groove 44 so that the vane 41 is able to reciprocally move in the groove 44 in the radial direction. A distance between the outer periphery of the rotor 40 and the inner bore 21 of the ring 20 changes according to rotation of the rotor 40 because the rotor 40 is eccentrically positioned relative to the inner bore 21. An outer end of each vane 41 contacts the inner bore 21 by a centrifugal force generated according to rotation of the rotor 40. As the distance between the outer periphery of the rotor 40 and the inner bore 21 changes according to rotation of the rotor 40, the vane 41 slidably moves in the groove 44 in the radial direction.

Figure 4:
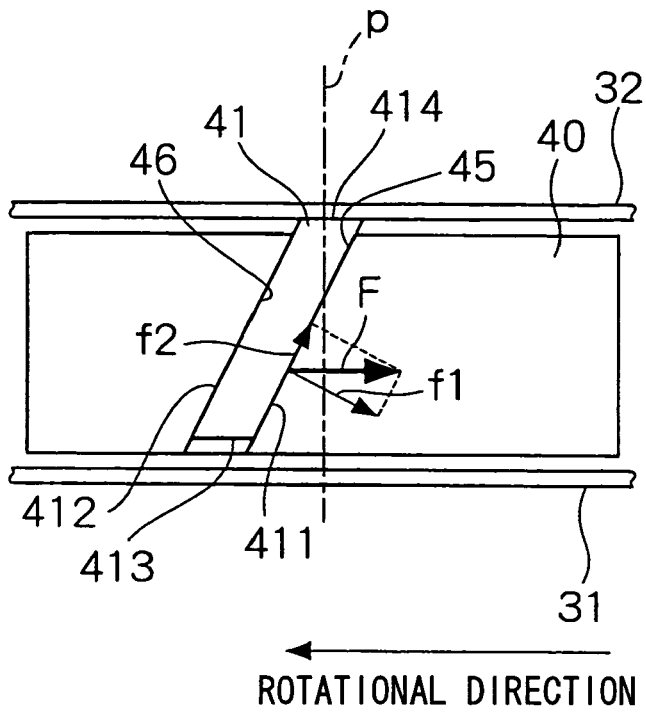
FIG. 4 is a schematic view showing a rotor and a vane in the vane pump.

As shown in FIG. 1, each groove 44 is slanted with respect to the rotational axis p of the rotor 40. In this particular embodiment, an upper end of the groove 44 (positioned at a side of the upper plate 32) is slanted to an opposite direction of the rotational direction. The vanes 41 are disposed in the slated grooves 44. As shown in FIG. 4, the vane 41 has a pair of side surfaces 411, 412, an upper end surface 414 and the lower end surface 413. These four surfaces of the vane 41 form a parallelogram cross-section when taken along a plane parallel to the rotational axis p. The groove 44 has a pair of slanted sidewalls 45, 46 that are parallel to each other. The vane 41 is disposed in the groove 44, so that the side surfaces 411, 412 slidably contact the sidewalls 45, 46, and the upper end surface 414 and the lower end surface 413 become parallel to the upper plate 32 and the lower plate 31, respectively.

Operation of the vane pump 10 will be briefly described. Fluid is sucked into the pump chamber 22 through the inlet port 23 and compressed in the pump chamber 22, and then the compressed fluid is pumped out through the outlet passage 24. The pump chamber between the neighboring vanes 41 is the largest at the position of the inlet port 23. The pump chamber 22 becomes gradually smaller according to rotation of the rotor 40 and becomes smallest at the outlet passage 24. The radial outer ends of the vanes 41 always contact the inner bore 21 of the ring 20 due to the centrifugal force applied to the vanes 41. Accordingly, fluid is continuously pressurized in the pump chamber 22 and pumped out through the outlet passage 24.

As shown in FIG. 4, when the rotor 40 rotates in the rotational direction, the vane 41 is pushed back by the fluid in the pump chamber 22 in the direction opposite to the rotational direction. The pushing force F is applied to the vane 41, and the pushing force F is divided into two components, a vertical component f1 that is applied to the vane 41 in a direction perpendicular to its side surface 411 and a parallel component f2 that is applied to the vane 41 in a direction parallel to its side surface 411. The vane 41 is pushed against the sidewall 45 by the component f1, while the vane 41 is pushed up by the component f2 toward the upper plate 32. Accordingly, the upper end surface 414 of the vane 41 is pushed against the upper plate 32, and the upper end surface 414 continues to contact the upper plate 32 while the rotor 40 is rotating.

Advantages attained in the present invention will be summarized. Since the upper end surface 414 of the vane 41 is pushed against the upper plate 32 while the rotor 40 is rotating, movement of the vane 41 in the axial direction is suppressed, and thereby hitting noises generated by collision of the vane 41 with the upper and lower plates 32, 31 are suppressed. This can be attained only by slanting the vanes relative to the rotational axis p without using any additional members such as the resilient rings.

Since the cross-section of the vane 41 is made in a parallelogram shape to correspond to the shape of the groove 44, the upper end surface 414 of the vane 41 contacts the upper plate in plane-to-plane fashion. Therefore, abrasion wear due to the sliding contact between the upper end surface 414 and the upper plate 32 can be minimized.

Figure 5:
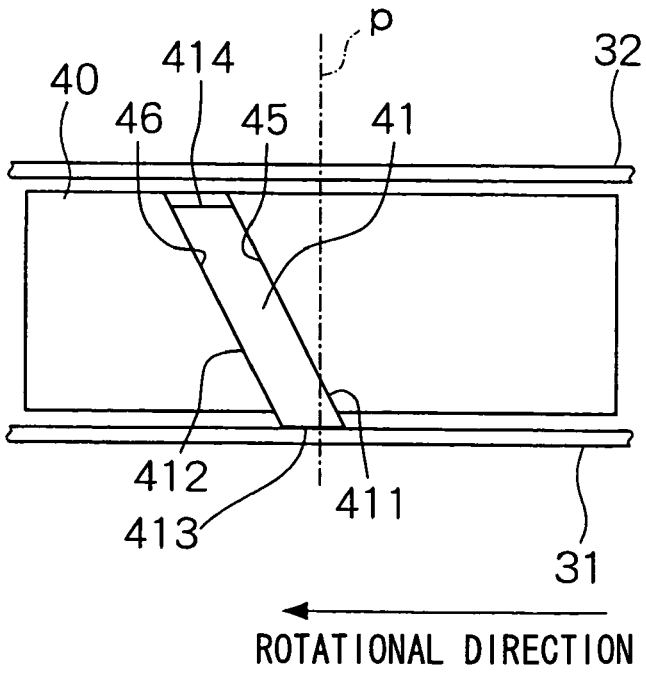
FIG. 5 is a schematic view showing a rotor and a vane in the vane pump, as a modified form of the present invention.

A modified form of the present invention is shown in FIG. 5. In this modified form, the groove 44 is slanted to a direction opposite to that of the embodiment shown in FIG. 4. In other words, the lower end of the groove 44 is positioned backward of the rotational direction while the upper end of the groove 44 is positioned forward of the rotational direction. The pushing force F is applied to the vane 41 in the same manner as in the foregoing embodiment. However, the parallel component f2 of the pushing force F is applied to the vane 41 in a downward direction, i.e., toward the lower plate 31. The lower end surface 413 of the vane 41 is pushed against the lower plate 31. The hitting noises due to collision between the vane 41 and the plates 31, 32 are suppressed in the same manner as in the foregoing embodiment shown in FIG. 4.

Figure 6:
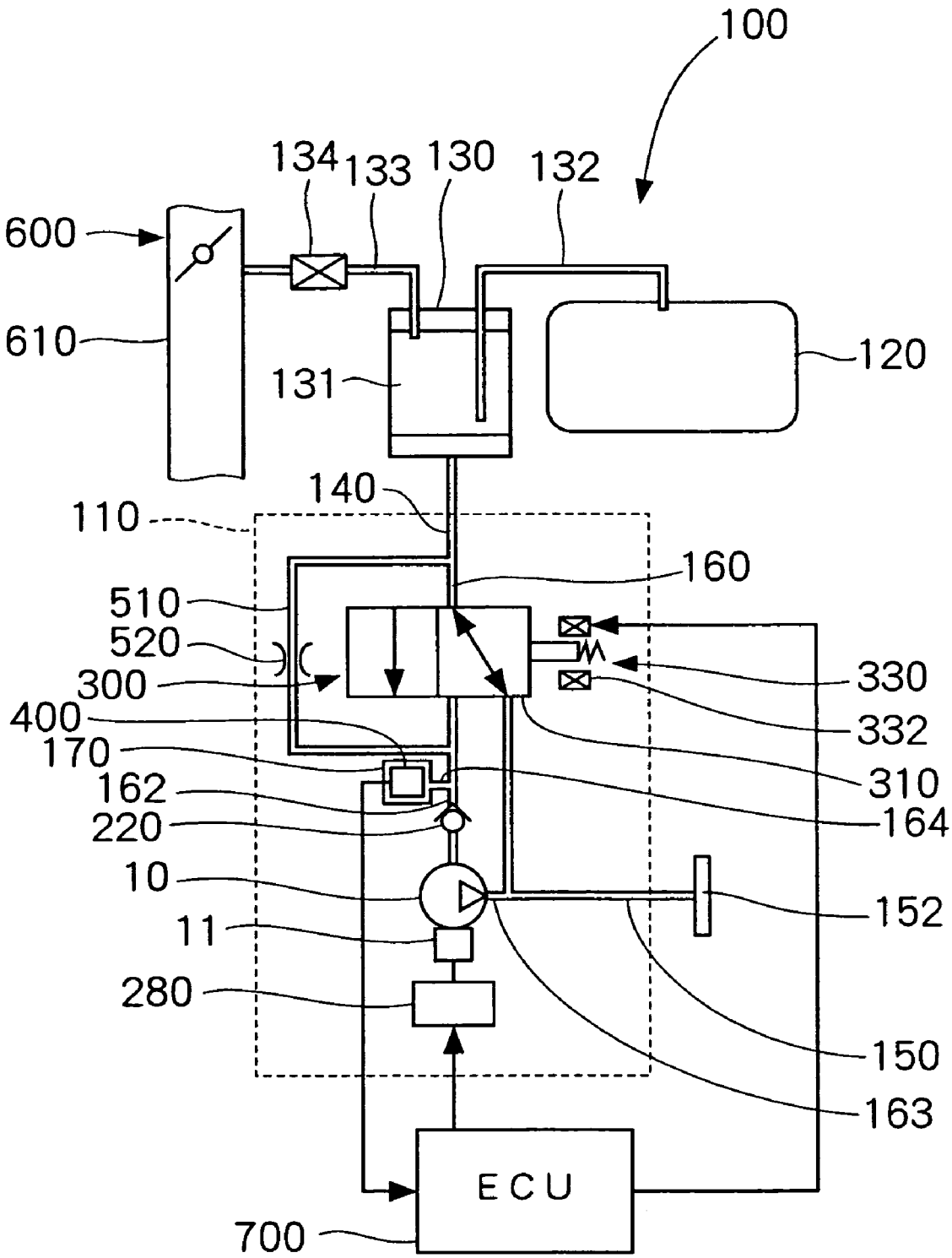
FIG. 6 is a block diagram showing a system for checking leakage in fuel evaporation control system for use in an automotive vehicle, in which the vane pump of the present invention is used.

Now, a system in which the vane pump 10 of the present invention is used will be described with reference to FIG. 6. In FIG. 6, a system for checking leakage in a fuel evaporation control system is shown. Evaporated fuel from a fuel tank of an automobile is absorbed by a canister and the absorbed fuel is supplied to an engine. The leakage checking system 100 includes: a test module 110, a fuel tank 120, a canister 130, an air-intake device 600 and an electronic control unit (referred to as an ECU) 700.

The test module 110 includes a vane pump 10, a motor 11, a switching valve 300 and a pressure sensor 400. The switching valve 300 and the canister 130 are connected through a canister passage 140. A canister passage 140 is connected to an atmospheric passage 150 through a connecting passage 160. The connecting passage 160 is connected to the inlet port 23 of the vane pump 10 through a pump passage 162. The outlet passage 24 of the vane pump 10 is connected to the atmospheric passage 150 through an outlet conduit 163. A sensor chamber 170 is connected to the pump passage 162 through a pressure-introducing passage 164 branched out from the pump passage 162. Thus, a pressure in the sensor chamber 170 is substantially equal to a pressure in the pressure-introducing passage 164 and the pump passage 162. A pressure sensor 400 is disposed in the sensor chamber 170.

The canister passage 140 is connected to the pump passage 162 through an orifice passage 510 branched out from the canister passage 140. An orifice 520 having an opening corresponding to an allowable amount of leakage including air and fuel from the fuel tank 120 is connected in the orifice passage 510. A one-way valve 220, which is open when the vane pump 10 is driven, is connected to the inlet port 23 of the vane pump 10.

The switching valve 300 includes a valve body 310 and a driving member 330 for driving the valve body 310. The driving member 330 includes a coil 332 connected to the ECU 700 that controls operation of the coil 332. When the coil 332 is not energized, communication between the connecting passage 160 and the pump passage 162 is interrupted, while the canister passage 140 communicates with the atmospheric passage 150 through the connecting passage 160. When the coil 332 is energized, the canister passage 140 communicates with the pump passage 162, while the canister passage 140 is interrupted from the atmospheric passage 150. The canister passage 140 always communicates with the pump passage 162 through the orifice passage 510 irrespective of whether or not the coil 332 is energized.

The canister 130 having absorbent 131 such as activated carbon is disposed between the fuel tank 120 and the test module 110. Fuel evaporated in the fuel tank 120 is absorbed to the absorbent 131 in the canister 130. The canister 130 is connected to the fuel tank 120 through a tank passage 132 and to the test module 110 through the canister passage 140. The canister 130 is also connected to an intake pipe 610 of the air-intake device 600 through a purge passage 133. A purge valve 134 that is opened or closed by the ECU 700 is disposed in the purge passage 133.

The pressure sensor 400 detects a pressure in the sensor chamber 170 and feeds signals corresponding to the detected pressure to the ECU 700. The ECU 700 is composed of a microcomputer including CPU, ROM and RAM. The ECU 700 performs controls according to programs stored in the ROM based on signals fed from various sensors including the pressure sensor 400.

Operation of the leakage checking system 100 described above will be explained. During a predetermined period after the automobile engine is stopped, the coil 332 is not energized, and the canister passage 140 communicates with the atmospheric passage 150 through the connecting passage 160. Air including fuel evaporated in the fuel tank 120 is supplied to the canister 130 where the evaporated fuel is absorbed in the absorbent 131. Air from which the evaporated fuel is removed flows through the canister passage 140, the switching valve 300 and the atmospheric passage 150, and flows out of the open end 152. The air does not flow into the vane pump 10 because the one-way valve 220 is closed in this period.

After the predetermined period lapsed, a test for detecting leakage from the fuel tank 120 is carried out. First, an atmospheric pressure is detected to calibrate errors due to an altitude at which the vehicle is parked. A pressure in the sensor chamber 170 is substantially equal to the atmospheric pressure because the sensor chamber 170 communicates with the atmospheric passage 150 through the switching valve 300 and the orifice passage 510 when the coil 332 is not energized. Therefore, the atmospheric pressure is detected by the pressure sensor 400 disposed in the sensor chamber 170. The altitude at which the vehicle is parked is calculated based on the detected atmospheric pressure, and parameters in the checking system are calibrated based on the altitude.

Then, the coil 332 is energized to switch the switching valve 300. The valve body 310 of the switching valve 300 moves rightward in FIG. 6, and thereby the canister passage 140 and the atmospheric passage 150 are interrupted while the canister passage 140 and the pump passage 162 are connected. When the fuel in the fuel tank 120 evaporates, a pressure in the fuel tank 120 becomes higher than the atmospheric pressure. When the pressure increase in the fuel tank 120 is detected, the ECU 700 de-energizes the coil 332. Upon de-energization of the coil 332, the canister passage 140 is connected to the atmospheric passage 150 through the switching valve 300 while the canister passage 140 is connected to the pump passage 162 through the orifice 520. The pump passage 162 is also connected to the atmospheric passage 150 through the orifice 520 and the switching valve 300.

Then, electric power is supplied to the motor 11 through a motor switch 280 based on a signal from the ECU 700. The vane pump 10 is driven by the motor 11 to decrease the pressure in the pump passage 162. At the same time, the one-way valve 220 is opened to introduce the atmospheric pressure from the atmospheric passage 150 to the pump passage 162 through the orifice 520. Since an amount of air flowing into the pump passage 162 is restricted by the orifice 520, the pressure in the pump passage 162 decreases up to a level corresponding to an opening of the orifice 520 and becomes constant thereafter. The pressure at this moment is memorized as a reference pressure, and the motor 11 is stopped.

Then, the coil 332 is energized again. The communication between the canister passage 140 and the atmospheric passage 150 is interrupted, and the canister passage 140 is connected to the pump passage 162 through the switching valve 300. The fuel tank 120 communicates with the pump passage 162, and therefore the pressure in the pump passage 162 becomes equal to the pressure in the fuel tank 120. The vane pump 10 is driven at this moment, and the one-way valve 220 is opened. According to operation of the vane pump 10, the pressure in the fuel tank 120 is decreased. The pressure in the sensor chamber 170 is substantially equal to the pressure in the fuel tank 120 because the sensor chamber 170 communicates with the fuel tank 120 through the pump passage 162, the switching valve 300 and the canister passage 140.

If the pressure in the fuel tank 120, i.e., the pressure in the sensor chamber 170 detected by the pressure sensor 400, decreases to a level lower than the memorized reference pressure according to operation of the vane pump 10, it is determined that an amount of leakage of the fuel tank 120 is within an allowable amount. That is, if the pressure in the fuel tank 120 becomes below the reference pressure, it is determined that no air enters into the fuel pump 120, or the amount of air entering into the fuel tank 120 is below the amount of air flowing through the opening of the orifice 520. Therefore, it is determined that the fuel tank 120 is kept sufficiently airtight.

On the other hand, it is determined that the leakage of the fuel tank is higher than the allowable level, if the pressure in the fuel tank 120 does not decrease to the level of the reference pressure. That is, it is determined that a certain amount of air enters into the fuel tank 120 according to operation of the vane pump 10. Therefore, in this case, it is determined that the fuel tank 120 is not kept sufficiently airtight.

When the above processes are completed, the motor 11 and the coil 332 are de-energized. After the ECU 700 detects that the pressure in the pump passage 162 has recovered the pressure level equal to the atmospheric pressure, the ECU 700 stops operation of the pressure sensor 400 and determines that the leakage test is completed.

Since the leakage test is performed when the engine is not operated, noises of the vane pump 10 driven in the process of the leakage test are easily heard from the outside. The vane pump 10 of the present invention is silently operated as described above. Therefore, the noises associated with the leakage test are sufficiently suppressed by using the vane pump 10 of the present invention in the system for checking leakage.

While the present invention has been shown and described with reference to the foregoing preferred embodiment, it will be apparent to those skilled in the art that changes in form and detail may be made therein without departing from the scope of the invention as defined in the appended claims.

What is claimed is:

1. A vane pump for compressing or decompressing fluid, comprising:

a casing having a cylindrical inner bore;

a rotor disposed in the inner bore with an eccentric ration thereto, forming a circular pump chamber between the inner bore and the rotor; and vanes slidably held in the rotor so that one end of each vane slidably contacts the inner bore by a centrifugal force generated by rotation of the rotor, the circular pump chamber being divided by the vanes to thereby form pump chambers each having a capacity changing according to rotation of the rotor, wherein:

the vanes are disposed in grooves formed in the rotor to be movable in the grooves in axial and radial directions of the rotor;

the grooves are slanted with respect to a rotational axis of the rotor; and the vane has a parallelogram cross-section taken along a plane parallel to the rotational axis of the rotor.

2. The vane pump as in claim 1, the vane pump being used in a system for checking leakage in a fuel evaporation control system for use in an automotive vehicle.

* * * * *